US006503487B1

(12) United States Patent
Ohba

(10) Patent No.: US 6,503,487 B1
(45) Date of Patent: Jan. 7, 2003

(54) CONTAINER FOR LIQUID COSMETICS

(75) Inventor: Atsushi Ohba, Tokyo (JP)

(73) Assignee: Suzuno Kasei Kabushiki Kaisha (JP)

( * ) Notice: Subject to any disclaimer, the term of this patent is extended or adjusted under 35 U.S.C. 154(b) by 0 days.

(21) Appl. No.: 09/650,379

(22) Filed: Aug. 29, 2000

(30) Foreign Application Priority Data

Aug. 30, 1999 (JP) ..... 11-243973

(51) Int. Cl.[7] ..... A61K 7/025; A61K 9/00; A45D 40/30; A45D 40/26

(52) U.S. Cl. ..... 424/64; 424/61; 424/400; 424/401; 132/216; 132/218

(58) Field of Search ..... 424/400, 64, 61, 424/401; 132/216, 218

(56) References Cited

U.S. PATENT DOCUMENTS 3,928,113 A * 12/1975 Rosenberg ..... 156/344

FOREIGN PATENT DOCUMENTS

JP 10099128 * 4/1998 ..... A45D/34/04
JP 11-4714 1/1999

* cited by examiner

*Primary Examiner*—Thurman K. Page
*Assistant Examiner*—Robert M. Joynes
(74) *Attorney, Agent, or Firm*—D. Peter Hochberg; Katherine R. Vieyra; Sean Mellino

(57) ABSTRACT

A container for liquid cosmetics having an aperture controlling ring that is restricted to 360 degrees or less by a convex piece of the aperture controlling ring and a rotation prevention piece of the bottle. A through hole is provided in the aperture controlling ring to allow a user to know the quantity of liquid cosmetics adhered to a stick-shaped applicator which is fixed to a cap, due to variable indicators provided at a container body. The container also prevents volatilization of the liquid cosmetics therein.

6 Claims, 8 Drawing Sheets

| UNIT: mm | TEST PIECE (1) | TEST PIECE (2) | TEST PIECE (3) | TEST PIECE (4) | TEST PIECE (5) | MAX. | MIN. | $\overline{X}$ | R |
|---|---|---|---|---|---|---|---|---|---|
| GRADUATION (1) | 2.515 | 2.555 | 2.534 | 2.552 | 2.539 | 2.555 | 2.515 | 2.539 | 0.040 |
| GRADUATION (2) | 2.515 | 2.579 | 2.580 | 2.567 | 2.550 | 2.580 | 2.515 | 2.558 | 0.065 |
| GRADUATION (3) | 2.542 | 2.610 | 2.621 | 2.605 | 2.607 | 2.621 | 2.542 | 2.597 | 0.079 |
| GRADUATION (4) | 2.612 | 2.649 | 2.660 | 2.668 | 2.703 | 2.703 | 2.612 | 2.658 | 0.091 |
| GRADUATION (5) | 2.691 | 2.776 | 2.793 | 2.764 | 2.785 | 2.793 | 2.691 | 2.762 | 0.102 |
| GRADUATION (6) | 2.852 | 2.900 | 2.960 | 2.918 | 2.941 | 2.960 | 2.852 | 2.914 | 0.108 |
| GRADUATION (7) | 3.029 | 3.113 | 3.152 | 3.088 | 3.133 | 3.152 | 3.029 | 3.103 | 0.123 |
| GRADUATION (8) | 3.207 | 3.340 | 3.385 | 3.352 | 3.345 | 3.385 | 3.207 | 3.326 | 0.178 |
| GRADUATION (9) | 3.457 | 3.506 | 3.587 | 3.526 | 3.588 | 3.588 | 3.457 | 3.533 | 0.131 |
| GRADUATION (10) | 3.681 | 3.714 | 3.805 | 3.715 | 3.769 | 3.805 | 3.681 | 3.737 | 0.124 |

FIG-7

CONTAINER FOR LIQUID COSMETICS

FIELD OF THE INVENTION

The present invention relates to a container for liquid cosmetics, such as mascara, eyeliner, and lip-gloss. More specifically, it relates to a container for liquid cosmetics which comprises in the container body a detachable applicator, such as a brush, and a drawing member having an opening for drawing surplus cosmetics adhered to the applicator and is capable of controlling the quantity of cosmetics adhered to the applicator by adjusting an aperture of the opening of the drawing member.

BACKGROUND OF THE INVENTION

With regard to this kind of container for liquid cosmetics which is capable of adjusting an aperture of the drawing member, several kinds of containers have already been known to the public. Among them, there are many containers having constitution in which an aperture of the drawing member is varied by vertically moving inside the container an aperture controlling section to be in contact with the drawing member. However those containers for liquid cosmetics have such a drawback that when twisting on or off a cap, the aperture controlling section unnecessarily makes a vertical movement resulting from torque applied to the aperture controlling section, thereby varying the aperture.

Further, in other applications disclosing containers in which an aperture of the drawing member is varied, these containers also have such a defect in common that when a cap is put, the aperture controlling section makes an unprepared rotation by the tightening force or at the final tightening step, whereby the aperture is varied.

SUMMARY OF THE INVENTION

An object of the present invention is to provide a container for liquid cosmetics which has a drawing member capable of controlling an aperture for drawing surplus cosmetics adhered to an applicator, is capable of controlling quantity of cosmetics adhered to the applicator, has simple structure and a small outer diameter, is excellent in user friendliness because an aperture controlling ring does not rotate when a user rotates a cap with a bottle section held at the time of daily use, and is also excellent in design and applicability to additive decoration.

Japanese Patent Laid-Open Publication Nos. Hei 10-99128 and Hei 11-4714 published by the Japanese Patent Office are examples of such an invention. However the present invention is an improvement of the inventions described above, and it provides a container for liquid cosmetics which can maintain sealing performance that can also be used for high volatile liquid cosmetics, such as eyeliner liquid and mascara liquid, is user friendly and has safe functions.

In order to achieve the object described above, a container for liquid cosmetics comprising: a container body and a cap section, wherein the container body comprising: a bottle section in which liquid cosmetics are filled up, an aperture controlling ring which is rotatably engaged around an axis of a tip of the bottle section and provided means for regulating a rotation start position and a rotation limit position, a neck section which is unrotatably and slidably provided in the bottle section, moved in an axial direction resulting from relative rotations of the aperture controlling ring and the bottle section and restricted movement in a axial direction by the means for regulating a rotation start position and a rotation limit position, an elastic body which is fixed in the container body, varied an aperture of a center opening of the elastic body from contact of an aperture controlling section provided at a tip of the neck section with the elastic body to control quantity of application of the liquid cosmetics adhered to an applicator, and the cap section provided a stick-shaped member having the applicator at its tip.

Further, a distance of movement in an axial direction of the neck section, which is spirally engaged with the aperture controlling ring, at the time of expanding a size of the center opening of the elastic body in the container body from a predetermined minimum size to a predetermined maximum size is determined based on quantity of rotations of the aperture controlling ring from a rotation start position to a rotation limit position.

When liquid cosmetics are used, the cap is removed from the container body in which the liquid cosmetics are filled up, and the liquid cosmetics are applied to eyelids, eyelashes, lips, or the like using the applicator fixed to a tip of the stick-shaped member which is stuck to the cap. The aperture controlling ring is rotatably put at the front of the bottle section. When the liquid cosmetics are used, if the aperture controlling ring is rotated before the cap is removed, the neck section engaged with the cap will move in an axial direction and the aperture controlling section which is a tip of the neck section will come into contact with the elastic body fixed at an upper part of the inside of the container body, whereby a dimensional diameter of the center opening of the elastic body is varied. Thus, quantity of the liquid cosmetics adhered to the applied part can be controlled according to a size of the center opening when the liquid cosmetics are used.

In order to simplify a degree of variation in an aperture of the center opening so that users can easily tell, the rotation start position and the rotation limit position of the aperture controlling ring are regulated and an aperture of the center opening of the elastic body is minimized at the rotation start position, whereby quantity of the liquid cosmetics adhered to the applicator becomes minimum. On the other hand, an aperture of the center opening of the elastic body is maximized at the rotation limit position, and quantity of the liquid cosmetics adhered to the applicator can easily be maximum. Further, since the neck section is installed inside the bottle section in a manner that it cannot rotate and can slide in an axial direction, at the time of daily use of the liquid cosmetics in a manner that the cap is rotated with the bottle section held, the aperture controlling ring is not torqued at all and the neck section does not move, whereby the aperture is never varied.

As described above, due to the aperture controlling ring, the dimensional diameter of the center opening of the elastic body is varied and the quantity of adhesion can easily be controlled. And the neck section arranged in the container body can move in an axial direction due to spiral engagement of a male screw formed at an outer diameter of the neck section and a female screw provided at an inner circumference of the aperture controlling ring.

With regard to a range of movement of the neck section in an axial direction, since an aperture of the center opening is varied when the aperture controlling section which is a tip of the neck section comes into contact with the elastic body as described above, the dimensional diameter of the center opening is varied from a minimum to a maximum. More specifically, the size of the center opening of the elastic body is set to a predetermined minimum at the rotation start position of the aperture controlling ring, and when the aperture controlling ring rotates, the neck section moves and the center opening of the elastic body gradually expands, whereby the size becomes a predetermined maximum at the rotation limit position. In other words, a distance of the movement of the neck section in an axial direction, which causes the center opening of the elastic body to vary, is determined based on quantity of rotations of the aperture controlling ring, whereby users can easily distinguish the quantity of liquid cosmetics adhered based on the quantity of rotations of the aperture controlling ring.

Further, an angle of rotations of the aperture controlling ring and the bottle section controlled by the means for regulating of the aperture controlling ring is 360 degrees or less. It is arranged such that the quantity of rotations will be restricted to 360 degrees or less if the aperture controlling ring comes into contact with the bottle section.

There is provided the container having means for indicating an angle of rotations of the aperture controlling ring and the bottle section from a rotation start position to a rotation limit position in a manner which allows a user to distinguish the quantity of rotations. Quantity of liquid cosmetics can easily be selected within the range of the rotation start position and the rotation limit position, namely, a minimum quantity and a maximum quantity.

The distinguishable indication means carry out selective indications using figures or patterns provided on the bottle section which are visible through a through hole made on the aperture controlling ring. By giving indications in a visible form, for example figures one through ten or an inclined zone which is diagonally printed with the color changed, the users can easily adjust the quantity of application.

The stick-shaped member having the applicator is provided with a thin diameter section, a taper section, and a section inserted-into neck section; a contact section of the center opening of the elastic body provided in the container body is always in contact with a position in an area covering from the thin diameter section to the taper section; and the section inserted-into neck section of the stick-shaped member can go in and out of the neck section leaving a minimum space between the section inserted-into neck section and an inner circumference of a through hole of the neck section. The thin diameter section or the taper section is installed at the stick-shaped member which is fixed to the cap and has an applicator at its tip. The center opening of the elastic body always comes into contact with the thin diameter section or the taper section, and between the neck section through hole and the section inserted-into neck section which is a rear part of the stick-shaped member and goes in and out of the neck section through hole, only a slide clearance with a minimum space is provided. Thus, it is possible to restrain a reverse drawing phenomenon at the time of using mascara which will be described hereinafter and to keep the stick-shaped member clean.

In the container for liquid cosmetics container for a container body in which liquid cosmetics are filled up; and a cap section to which a stick-shaped member having an applicator at its tip is fixed, wherein the container body comprising: a bottle section whose element is an elastic body for drawing the applicator; an aperture controlling ring which is rotatably engaged with the bottle section; and a neck section which moves in an axial direction resulting from relative rotations of the aperture controlling ring and which forms at its tip an aperture controlling section to control an aperture of a center opening of the elastic body; and further a sealing member for interrupting ventilation is provided between an outer circumference of the neck section and an inner circumference of the bottle section. The sealing member, such as an O-ring, is provided between the outer circumference of the neck section and the inner circumference of the bottle section, inflow of air from a sliding part between the outer circumference of the neck section and the inner circumference of the bottle section is shut out so that volatilization of the liquid cosmetics is prevented.

The details as well as other features and advantages of this invention are set forth in the remainder of the specification and are shown in the accompanying drawings.

BRIEF DESCRIPTION OF THE DRAWINGS

FIG. 2(*a*) shows the cap section 6; FIG. 2(*b*) shows a container body 7.

FIG. 7 is a table showing the measured sizes of an opening at each graduation.

DETAILED DESCRIPTION OF THE INVENTION

Figure 1:
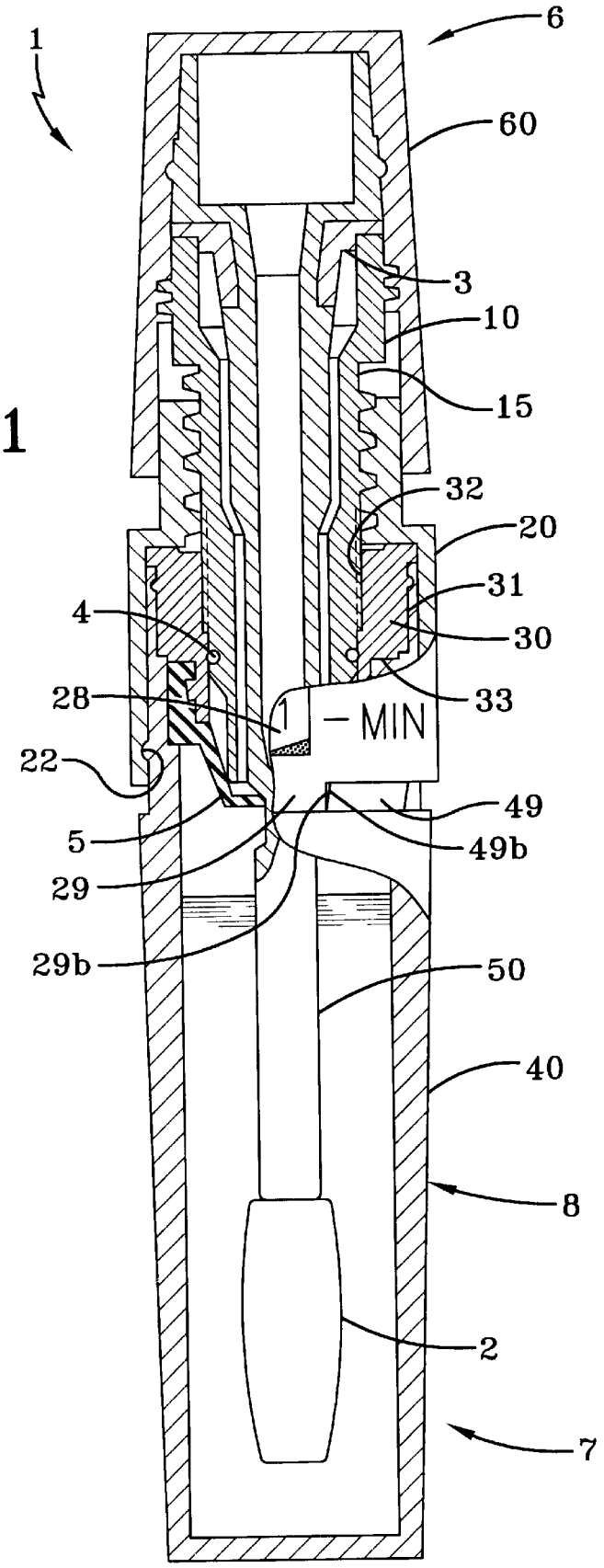
FIG. 1 is a partially longitudinal sectional view showing a state which an aperture controlling ring of the container for liquid cosmetics 1 according to an embodiment of the present invention is at a rotation start position.

Referring to FIG. 1, the container body 7 is composed of a bottle section 8 which comprises a support ring 30, an elastic body 5, and a bottle 40, a neck section 10, the aperture controlling ring 20, and an O-ring 4. The cap section 6 is composed of a cap 60, a stick-shaped member 50, an applicator 2 which is stuck to a tip of the stick-shaped member 50, and packing 3 which comes into contact with an upper end surface 15 of the neck section 10 in the container body 7 and shuts out air.

Figure 2A:
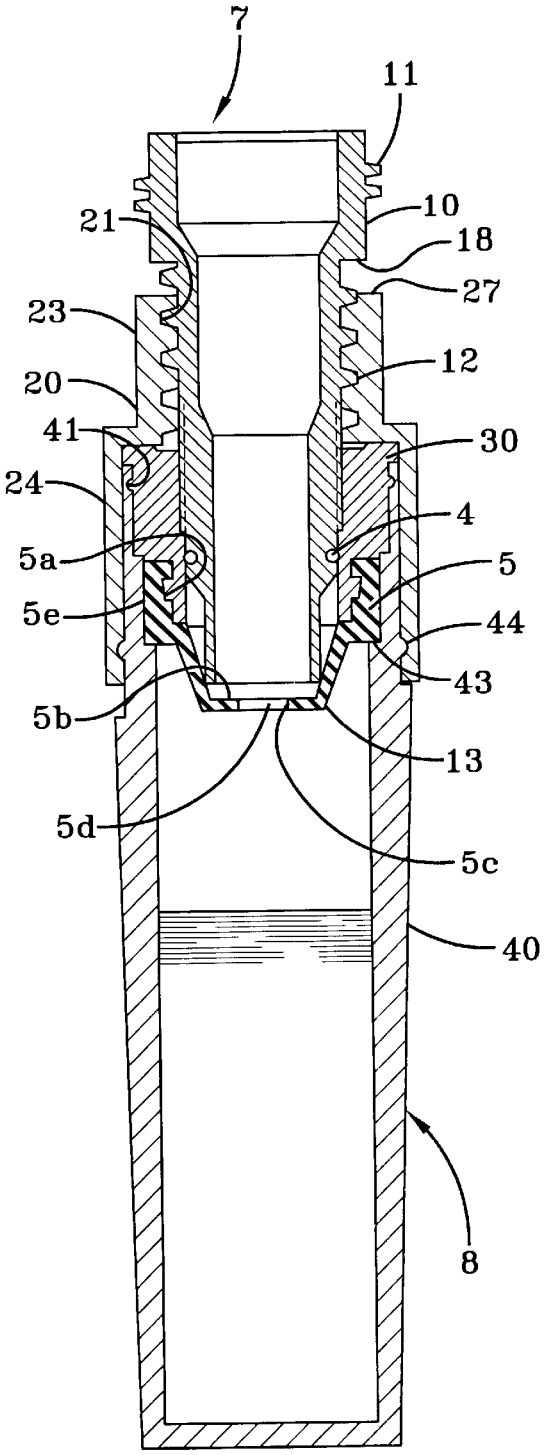
FIG. 2 is a partially longitudinal sectional view showing a state which liquid cosmetics can be used after removing a cap section 6 of the container for liquid cosmetics 1 shown in FIG. 1.
Figure 2B:
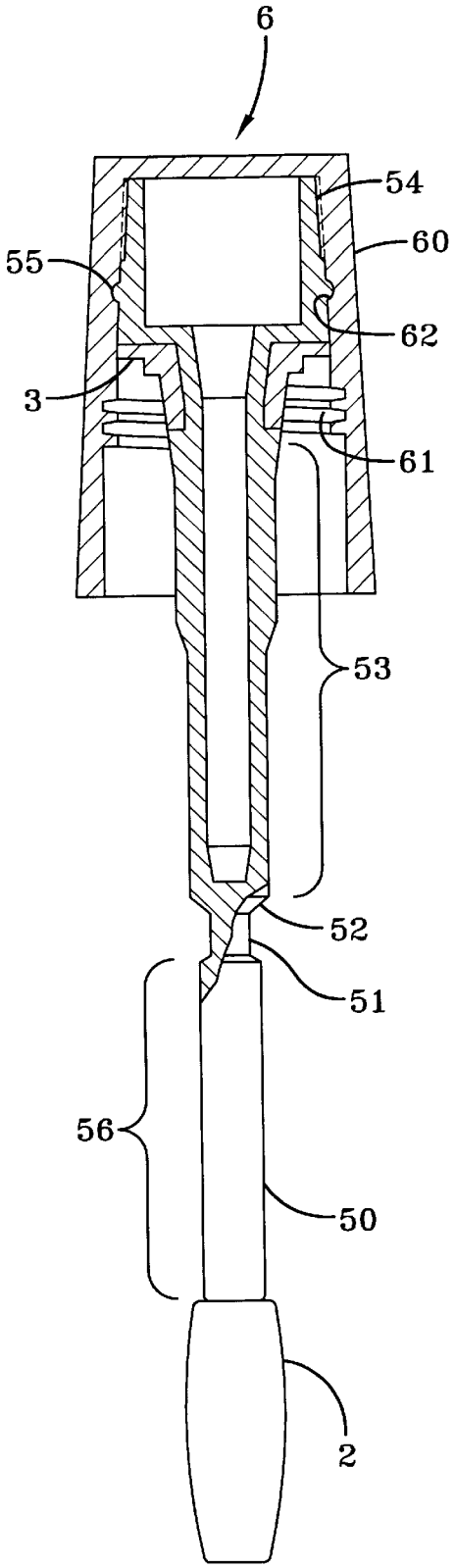
Figure 3:
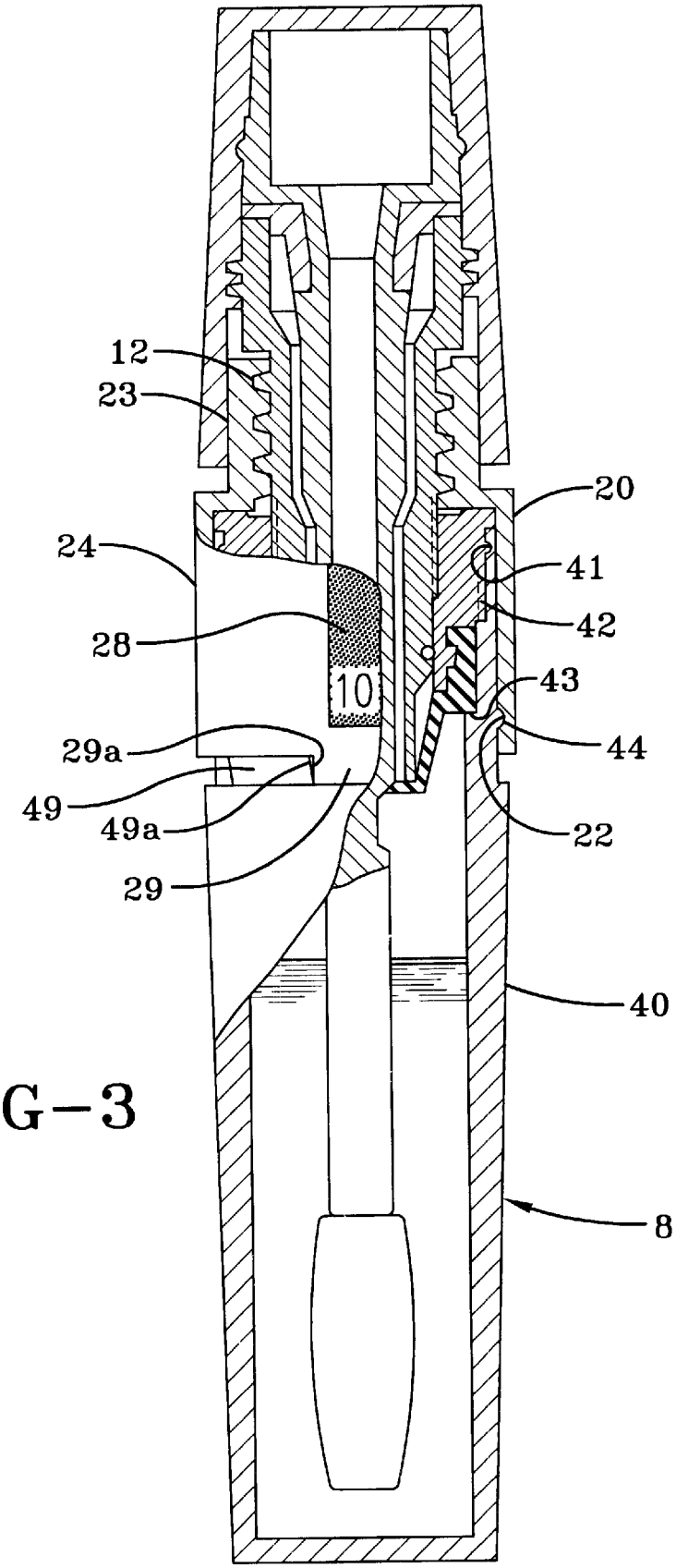
FIG. 3 is a partially longitudinal sectional view showing a state which an aperture controlling ring 20 of the container for liquid cosmetics 1 according to an embodiment of the present invention is at a rotation limit position.

Referring to FIGS. 1 through 3, a step section 43 is installed inside the bottle 40 and a large diameter section 5*e* of the elastic body 5 is placed thereon, and a concave circular section 41 to hold the support ring 30 in place and a spline 42 which is engaged with an engagement line section 31 of the support ring 30 are provided at an inside diameter of the upper end of the bottle 40. Means are taken for synchronously rotating the support ring 30 and the bottle 40. Further, a convex circular section 44 on which the aperture controlling ring 20 is put in a manner that the aperture controlling ring 20 can rotate is provided at an outer diameter of the bottle 40. With regard to the elastic body 5, the large diameter section 5*e* is placed on the step section 43 of the bottle 40 described above and the elastic body 5 is engaged with the support ring 30 at its fitting section 5*a*. The elastic body 5 is fixed in the bottle 40 in a manner that it is sandwiched between a lower end surface 33 of the support ring 30 and the step section 43 of the bottle 40, thereby forming the bottle section 8. Referring to FIG. 2(*a*), cap section 6 includes internal threads 54, 55 and 62 for engaging external threads on stick-shaped member 50.

The aperture controlling ring 20 described above is composed of an upper cylinder section 23, a lower cylinder section 24, and a convex piece 29. And a fitting concave section 22 which rotates together with the bottle section 40 is formed in the lower cylinder section 24. Further, a female screw section 21 is installed in the upper cylinder section 23 and is spirally engaged with a lower male screw 12 of the neck section 10.

Figure 4:
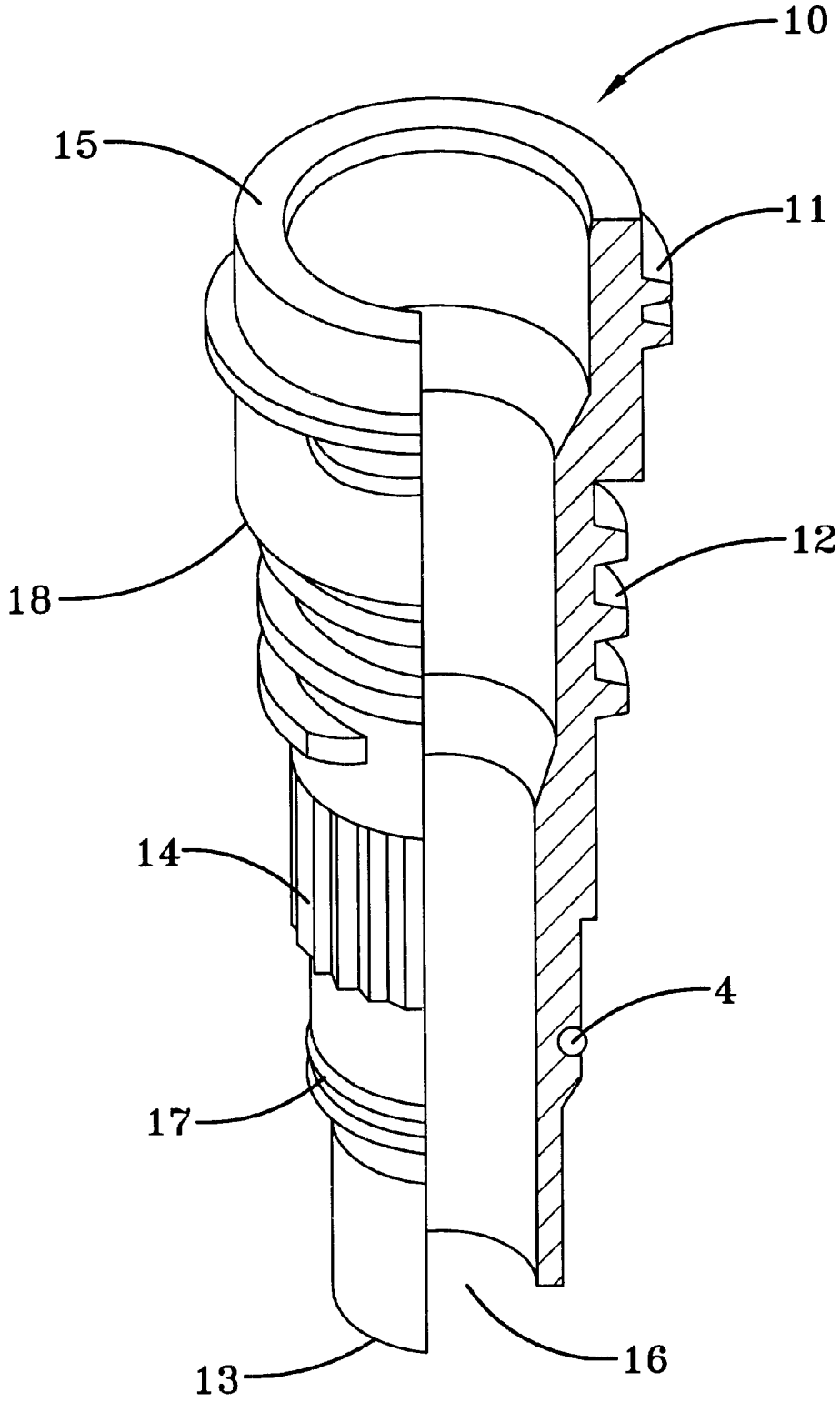
FIG. 4 is a partially breaking perspective view of a neck section 10.

Referring to FIG. 4, the neck section 10 is cylindrical body as a whole, and a male screw 11 to be used for engaging with cap section 6 at internal threads 61 (FIG. 2(*b*)) is installed at the upper part of the neck section 10, the male screw 12 to be spirally engaged with the internal female screw section 21 of the aperture controlling ring 20 is installed at the middle section of the neck section 10, an engagement line section 14 to be engaged with an internal engagement line section 32 of the support ring 30 is installed at a lower section of the male screw 12, and a fitting concave section 17 to be equipped with the O-ring 4 is installed at a further lower section of an engagement line section 14. A shoulder 18 (FIG. 2(*b*)) is provided at the upper part of neck section 10 just above male screw 12. The lower end section of the neck section 10 is an aperture controlling section 13 which comes into contact with the elastic body 5, and a through hole 16 in which a stick-shaped member stuck to a cap 60 is taking out and putting in is provided at the lower end section.

Figure 6C:
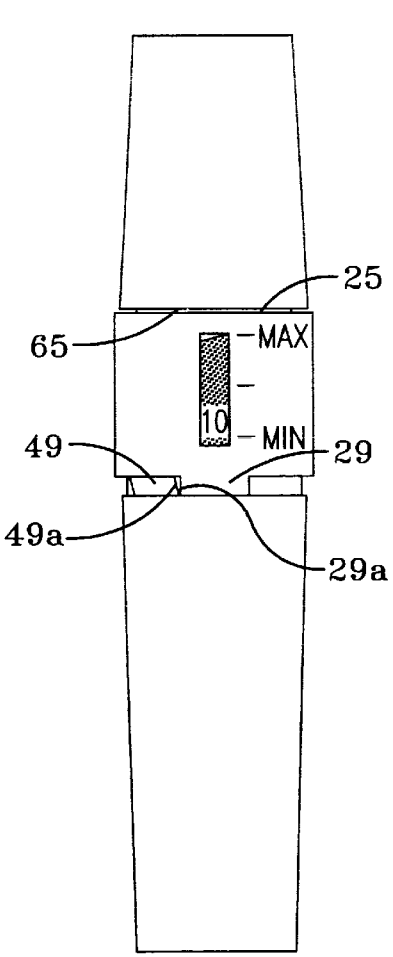
FIG. 6 is an elevational view showing a variation of indication corresponding to rotations of the aperture controlling ring which is visible through a through hole.

A mechanism of the container for liquid cosmetics 1 which has the constitution as mentioned above will be described. FIG. 6(A) is a sketch drawing of the container for liquid cosmetics 1 (minimum opening of the elastic body) shown in FIG. 1; FIG. 6(C) is a sketch drawing of the container for liquid cosmetics 1 (maximum opening of the elastic body) shown in FIG. 3.

If the aperture controlling ring 20 of the container for liquid cosmetics 1 in the state shown in FIG. 1 is rotated counterclockwise toward the bottle 40 when viewed from an upper direction, the male screw 12 of the neck section 10 spirally engaged with the female screw section 21 in the aperture controlling ring 20 and the lower section engagement line section 14 of the neck section 10 will be engaged with the internal engagement line section 32 of the support ring 30. If the bottle 40 and the aperture controlling ring 20 are rotated relatively to each other due to a rotation stop which is a means to cause the support ring 30 itself to make a rotation synchronously with the bottle 40, a feeding mechanism will operate and the neck section 10 will advance downward synchronously rotating with the bottle 40 in response to a rotation of the aperture controlling ring 20. Thus, the aperture controlling section 13 at a lower end surface of the neck section 10 will push down an aperture controlling section contact surface 5*b* of the elastic body 5 shown in FIG. 2, thereby enlarging a dimensional diameter of the center opening 5*d*, namely, an aperture.

Further, referring to FIG. 1, a stick-shaped section contact section 5*c* of the elastic body 5 which is in contact with a thin diameter section 51 of the stick-shaped member 50 fixed to the cap 60 comes into contact with a taper section 52 of the stick-shaped member 50 which comes down together with the cap 60 as the center hole 5*d* becomes large. An aperture of the center hole 5*d* becomes maximum due to the movement of the neck section 10. Therefore, the aperture controlling ring 20 can rotate until the state shown in FIG. 3 is realized.

Figure 6B:
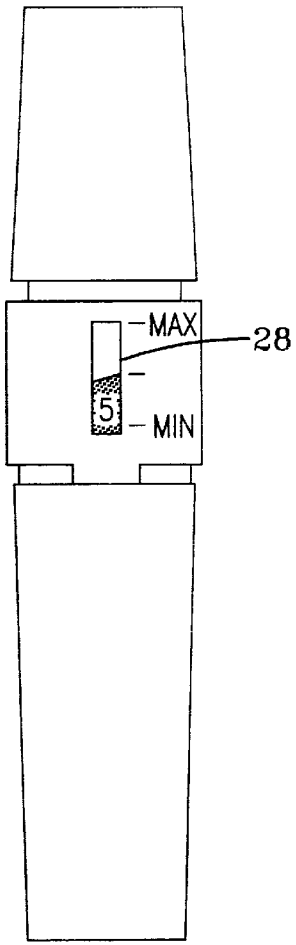
Figure 6A:
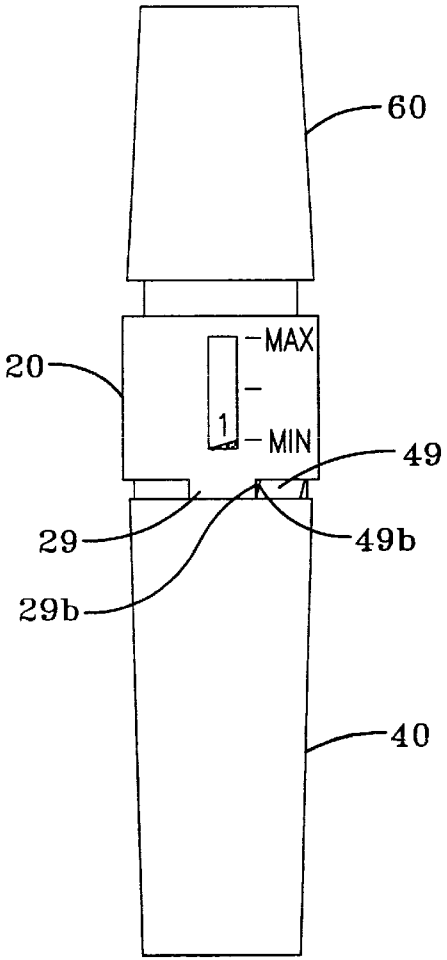

Referring to FIGS. 6(A), 6(B), and 6(C), in this embodiment of the present invention, the rotation of the aperture controlling ring 20 is restricted to 360 degrees or less due to a rotation prevention piece 49 formed at the bottle 40 and the convex piece 29 which projects from the aperture controlling ring 20. As shown in FIG. 1, it is designed such that when a rotation prevention piece left side 49*b* and a convex piece right side 29*b* come into contact with each other, the stick-shaped member contact section 5*c* of the elastic body 5 comes into contact with the thin diameter section 51 of the stick-shaped member 50 in a state which the elastic body 5 makes its center opening 5*d* minimum. If the center opening 5*d* is pushed by the above-mentioned feeding mechanism and the aperture of the center opening 5*d* becomes large, the stick-shaped member contact section 5*c* will be in contact with the taper section 52 of the stick-shaped member 50 in a state which a rotation prevention piece right side 49*a* and a convex piece left side 29*a* are in contact with each other as shown in FIG. 3.

Figure 8:
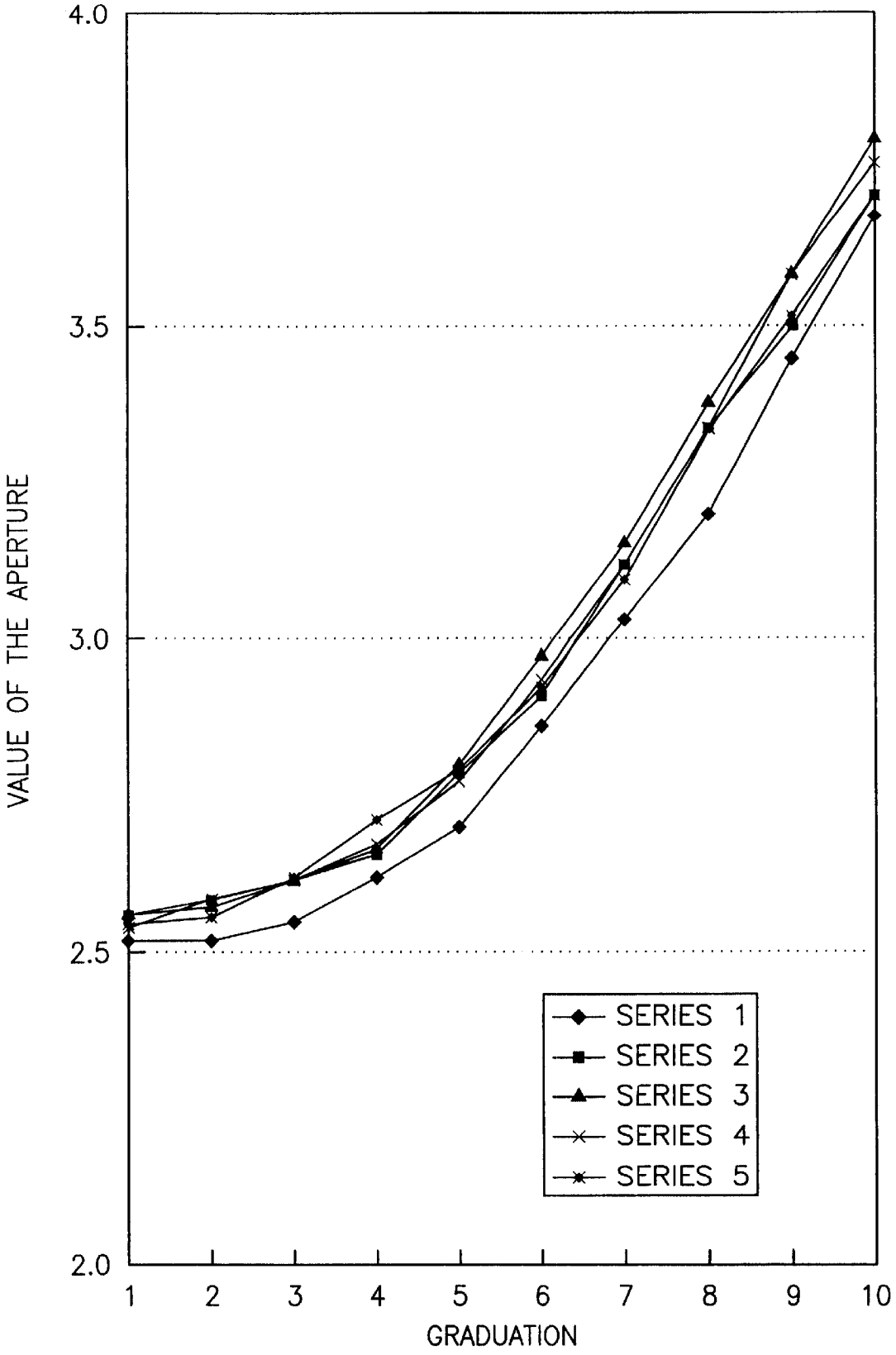
FIG. 8 is a graph showing the measured values shown in FIG. 7.

In this embodiment, the size of the center opening 5*d* is set so that the diameter is approximately 2.5 millimeters at a minimum and approximately 3.8 millimeters at a maximum. FIGS. 7 and 8 show data of the aperture of the center opening 5*d* measured. Attention to be paid here is that when the aperture of the center opening 5*d* is maximum, if an external size of an extended section 56 of the stick-shaped member 50 is always rendered to be larger than the maximum opening of the elastic body mentioned above, surplus liquid cosmetics adhered to the extended section 56 can be drawn so as to use it cleanly.

The containers for liquid cosmetics in which the center opening 5*d* of the elastic body 5 is varied have the most common feature that the thin diameter section 51 is formed at a part which the elastic body 5 of the stick-shaped member 50 fixed to the cap 60 comes into contact with.

Existing liquid cosmetics, such as mascara have a common fault as follows. A drawing member is made of rubber, such as NBR (butadiene-acrylonitrile rubber), and the liquid adhered to a brush is drawn so that quantity of the liquid adhered is adjusted. Thus, when the brush is drawn, quantity of the liquid is adjusted. This process itself is not a drawback, but the problem is that when the brush is returned to the inside of the container body again after using it, remaining liquid is drawn in reverse (hereinafter referred to as a reverse drawing phenomenon) because the brush passes through the elastic body again, whereby a large amount of liquid cosmetics are adhered to an upper surface of the elastic body. More specifically, if quantity of liquid, such as mascara, adhered to the brush is 10 mg, remaining liquid of approximately 6 mg to 7 mg will still be adhered to the brush used. If the brush is returned to the container body through the elastic body again, quantity of liquid of 2 to 3 mg adhered will remain on the upper surface of the elastic body due to the reverse drawing phenomenon.

When the drawback is applied to this embodiment and compared with conventional mascara which an aperture of the drawing member does not vary, if an aperture of the center opening 5*d* is minimum, a reverse drawing phenomenon which leaves quantity of liquid adhered several times as much as that of the conventional mascara will arise in this embodiment. Thus, if the stick-shaped member 50 is pressed in and pulled out again, the taper section 52 and a section inserted-into neck section 53 centering around the thin diameter section 51 of the stick-shaped member 50 will become remarkably dirty, thereby making users uncomfortable.

Further, liquid cosmetics which remain on the aperture controlling section contact surface 5*b* of the elastic body 5 exerts a harmful influence on the functions of the container. Thus, the through hole 16 of the neck section 10 has to be designed to have a minimum slide clearance to allow the section inserted-into neck section 53 of the stick-shaped member 50 to go in and out of the through hole 16. Also, residual solution which collects in the neck section 10, particularly around the aperture controlling section 5*b* of the elastic body 5 has to be driven out downward. Further, if it is done, the stick-shaped member 50 can be kept clean.

Further, "dry up effect" (quick drying) after adhesion of liquid cosmetics is a criterion for judging the quality of the liquid cosmetics, such as mascara. Thus, the container's sealing performance against volatilization of liquid cosmetics is the most important point regardless of aqueous ness or oiliness. In the case of a container for cosmetics in which liquid cosmetics are filled up, generally, it is necessary to restrain evaporation of the liquid cosmetics up to three percent even after one year elapses.

In the case where the center opening 5*d* is varied by expanding the center opening 5*d* of the elastic body 5 by means of the aperture controlling section 13 provided at a tip of the neck section 10, it is important to maintain the sealing performance more carefully than the case of an ordinary container for liquid cosmetics.

Figure 5A:
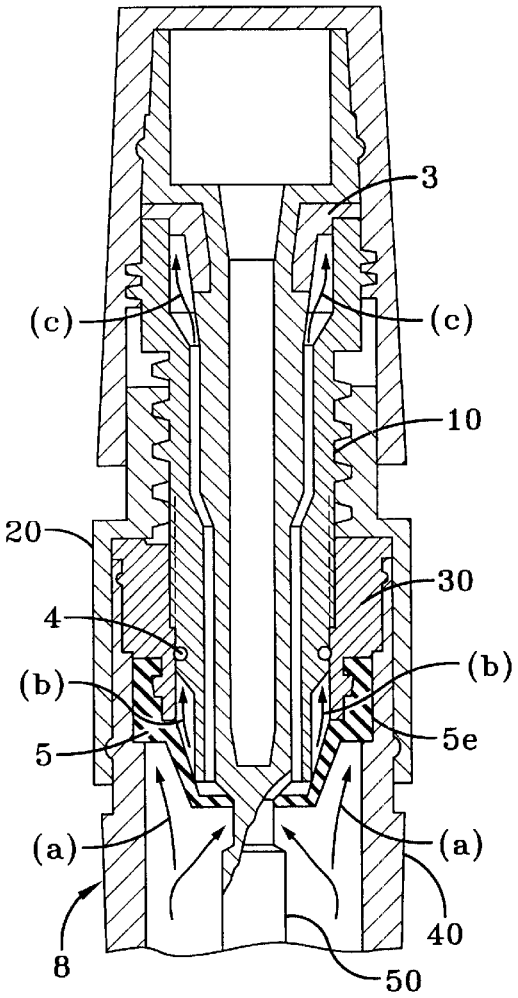
FIG. 5 is a partially longitudinal sectional view showing air flows.
Figure 5B:
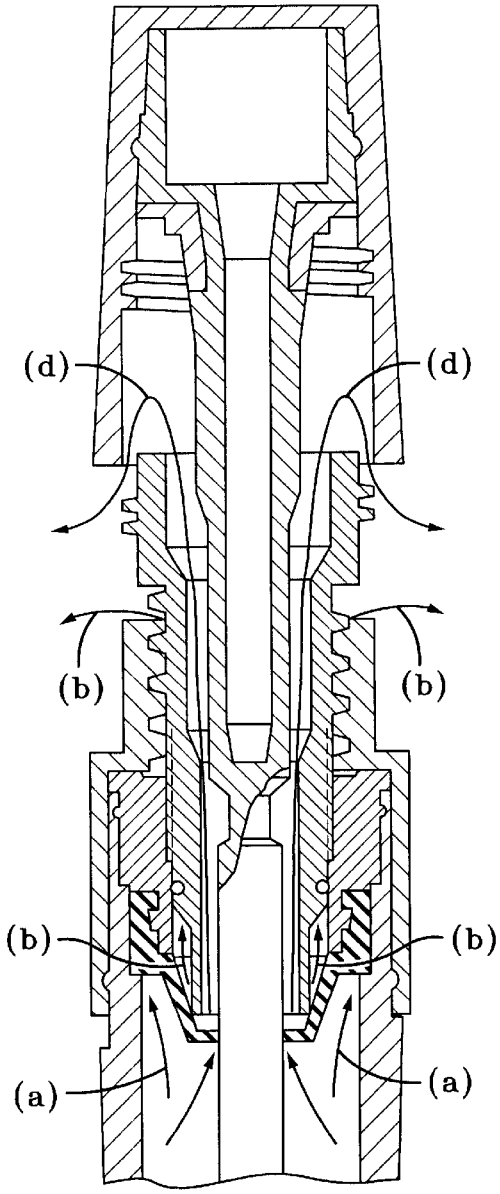

FIGS. 5(*a*) and 5(*b*) show the flows of air of volatilized solution in the container for liquid cosmetics according to the present invention. FIG. 5(*a*) shows a sealed state created by twisting the cap. Prevention of volatilization in this case is an important point. Arrows (a), (b), (c), and (d) in FIGS. 5(*a*) and 5(*b*) shown a state of air of volatilized solution. Incidentally, arrows (d) in FIG. 5(*b*) show the conditions at the time of use (a state of the cap being spirally released).

First, it is almost impossible for solution to volatilize from the airflow lines shown by arrows (a) which passes a joining section of the elastic body 5 and the bottle 40 because the large diameter section 5*e* of the elastic body 5 forms the bottle section 8 in a manner that it is firmly sandwiched between the support ring 30 and the container body and is stuck to an inside diameter of the bottle 40. In the case of airflow lines shown by arrows (b) and (c), there is the most likely possibility of volatilization. Among the airflow lines, in the case of the airflow lines shown by arrows (c) which pass a slide section between an outer circumference of the stick-shaped member 50 and an inner circumference of the neck section 10, it is not likely to lead to volatilization same as the case of the airflow lines shown by the arrows (a). The reason is that in this embodiment, the sealing performance is heightened by means of the packing 3 in a condition which the cap 60 is put as shown in FIG. 5(*a*) and the section inserted-into neck section 53 of the stick-shaped member 50 is close to the through hole 16 of the neck section 10 described above leaving only a slight space between the section inserted-into neck section 53 and the through hole 16, thereby having a further effect as an air cut-off layer when cosmetic solution enters there.

As it is clear from the aforementioned description, there is the most likely possibility of volatilization from the airflow lines shown by the arrows (b) which pass a joining section of the bottle section 8, the aperture controlling ring 20, and the neck section 10 in FIG. 5(*b*). Thus, sealing performance is required most in this airflow lines. This area is entirely used as a slide section and therefore it is more than likely to have an escape of volatilized air, for example, a male screw, a female screw, or a synchronous engagement section (the internal engagement line section 32 of the support ring 30 and the engagement line section 14 of the neck section). Therefore, such a problem is solved by taking measures for shutting out air between the neck section 10 and the support ring 30 such that at an outer diameter of the neck section 10 shown in FIG. 4, the O-ring concave section 17 is provided and an O-ring (sealing member) is equipped.

As described above, this embodiment is characterized in that in response to the rotations of the aperture controlling ring 20, the neck section 10 sealed by spiral engagement with the cap 60 makes synchronous rotations with the bottle 40 in an axial direction, in other words, the neck section 10 descends unrotatably to the container body and the aperture controlling section 13 provided at a tip of the neck section 10 comes into contact with the elastic body 5, whereby a function to expand the center opening 5*d* is provided and also volatilization of liquid cosmetics can surely be prevented, and further even though the cap 60 is put with the bottle 40 held, the center opening 5*d* of the elastic body 5 does not vary.

How to use the container for liquid cosmetics 1 according to the embodiment of the present invention will be described with reference to FIG. 6. First, a user removes the cap 6 from the container body 7 in a state shown in FIG. 1(A). A through hole 28 is vertically formed in the aperture controlling ring 20 and markings "MAX" and "MIN" are provided at an upper end and a lower end, respectively. Further, in order to be visible through the through hole 28, FIGS. 1 through 10 and an inclined zone pattern diagonally printed are provided at the bottle 40.

When the figure which can be read through the through hole 28 is one and a small quantity of liquid cosmetics are adhered to a brush which is an applicator, the user puts the cap 60 again and rotates the aperture controlling ring 20 up to the position shown in FIG. 6(C). Then, the figure of the bottle 40 which can be read through the through hole 28 of the aperture controlling ring 20 is ten and the inclined zone pattern is displayed on a full scale. This indicates that quantity of liquid cosmetics adhered to the brush is maximum. If the user rotates the aperture controlling ring 20 until a figure (1 through 10) corresponding to the quantity of adhesion which is suitable for the user's preference or way of makeup appears, it will be possible to apply desirable quantity of liquid to the brush.

In this embodiment, the convex piece 29 is provided at the aperture controlling ring 20 and the rotation prevention piece 49 is provided at the container body, respectively. When the aperture controlling ring 20 is at the rotation start position together with the bottle 40, the convex piece 29 and the rotation prevention piece 49 are prevented from rotating in a reverse direction. In this state, an aperture of the center opening 5*d* of the elastic body 5 shown in FIG. 6(A) is minimum. On the other hand, in the state shown in FIG. 6(C) which the aperture controlling ring 20 is fully rotated, the aperture of the center opening 5*d* of the elastic body 5 is maximum and no further rotation is possible.

Further characteristic of this embodiment is: by regulating the rotation start position and the rotation limit position, the male screw 12 of the neck section 10 is spirally engaged with the female screw section 21 provided in the aperture controlling ring 20, and by regulating the rotation to 360 degrees or less, it is regulated such that the center opening 5*d* of the elastic body 5 is minimum in the case of the rotation start position and the center opening 5*d* is of predetermined maximum size in the case of the rotation limit position.

Due to this regulation of rotations, the neck section 10 does not fall out from the aperture controlling ring 20, breakage of the elastic body 5 which may occur resulting from pushing it too far is prevented, and the center opening 5*d* of the elastic body 5 can be expanded to predetermined size.

As described above, in this embodiment, the rotation of the aperture controlling ring 20 is restricted to 360 degrees or less due to the convex piece 29 of the aperture controlling ring 20 and the rotation prevention piece 49 of the bottle 40. However, needless to say, measures for regulating the rotation to 360 degrees or less are not restricted to the above. It is also preferable that for example, a convex piece is installed at a declined step which is provided at a lower part of the female screw section 21 of an internal circumference of the aperture controlling ring 20 and another convex piece which is engaged with the aforementioned convex piece is also formed on an upper end surface of the support ring 30 so as to use it as a regulating piece. In this case, the convex piece does not appear at the surface, thereby providing a simple appearance. At any rate, it is possible to restrict the rotation to 360 degrees or less by forming such convex pieces at the aperture controlling ring 20, which rotates around the axis of the bottle section 8, and components of the bottle section 8, such as the bottle 40, the support ring 30, and the like.

The methods of assembling the center hole 5*d* of the elastic body 5 so as to be minimum at the rotation start position and maximum at the rotation limit position will be subsequently be described.

Referring to FIG. 2(*b*) and FIG. 3, the bottle section 8 is formed by setting the elastic body 5 engaged with the support ring 30 into the bottle 40 together with the support ring 30. The male screw 12 of the neck section 10 is then spirally engaged with the female screw section 21 provided in the aperture controlling ring 20. With the neck section 10 being inserted in the aperture controlling ring 20 until the spiral engagement is completed, the fitting concave section 22 of the aperture controlling ring 20 is inserted into the convex circular section 44 of the bottle 40 so as to engage with each other so that the convex piece left side 29*a* of the convex piece 29 of the aperture controlling ring 20 is in contact with the rotation prevention piece right side 49*a* of the rotation prevention piece 49 of the bottle 40 as shown in FIG. 3 {FIG. 6 (*c*)}. At this time, the container body 7 is completely assembled.

The state mentioned above represents a rotation limit position and also represents that the center hole 5*d* of the elastic body is in a maximum opening state. The rotation start position shown in FIG. 1 is at a position where the convex piece right side 29*b* of the convex piece 29 comes in contact with the rotation prevention piece left side 49*b* of the rotation prevention piece 49 by rotating the aperture controlling ring 20 from the rotation limit position. Here, an aperture of the center hole 5*d* of the elastic body 5 becomes minimum. In this embodiment, it is very difficult to carry out assembling with the center hole 5*d* of the elastic body 5 being in a minimum opening state. Relative positioning of the aperture controlling ring 20 and the neck section 10 when the aperture of the center hole 5*d* mentioned above is minimum is regulated by the state of spiral engagement of the aperture controlling ring 20 with the neck section 10 and the engagement in an axial direction of the support ring 30 with the aperture controlling ring 20 and the neck section 10. In other words, it is difficult to obtain, during the assembling, an accurate rotation start position in which the aperture controlling section 13 provided at a tip of the neck section 10 is in contact with the center hole 5*d* of the elastic body 5 or the aperture controlling section 13 is about to press the center hole 5*d*. In concrete, when the female screw section 21 of the aperture controlling ring 20 is spirally engaged with the male screw 12 provided at an outer diameter of the neck section 10, there is nothing to set up a standard, whereby it is difficult to estimate that in which engagement position the support ring 30 and the bottle 40 should be assembled so as to obtain the accurate rotation start position described above.

Thus in this embodiment, assembling is performed in such a manner that a rotation limit position is obtained when the neck section 10 and the aperture controlling ring 20 are in a state of complete spiral engagement, and then the rotation start position is defined by returning the aperture controlling ring 20.

Regulation of rotations of the aperture controlling ring 20 is inevitable, and the aperture of the center hole 5*d* of the elastic body 5 should be minimum at the time of rotation start and maximum at the time of the maximum rotation. However, the rotation is not restricted to 360 degrees or less.

For example, it is preferable that a rotation start position is regulated by bringing a flange member installed in the neck section 10 into contact with an upper inside surface of the aperture controlling ring 20, and a contact point of a cap end surface 65 with a shoulder section 25 of the aperture controlling ring 20 shown in FIG. 6(*c*) is used as a maximum rotation limit. It is also preferable that a contact point of a step section 18 of the neck section 10 with an upper end surface 27 of the aperture controlling ring 20 shown in FIG. 2(*b*) is used as a rotation limit.

If the male screw 12 of the neck 10 and the female screw section 21 in the aperture controlling 20 are regulated in the manner described above, it will be possible to stop the aperture controlling ring 20 after two or three rotations However, considering facilitation or efficiency of the assembling, it will further facilitate the assembling if a rotation regulating mechanism is provided at a location where a user can confirm with his or her eyes as described in this embodiment.

FIG. 7 is a table showing the respective sizes of the center hole 5*d* measured in millimeter which correspond to the respective graduations, namely, the respective values of five test pieces read through the through hole 28 of the aperture controlling ring 20.

FIG. 8 is a graph showing the respective measured sizes of the center hole 5*d* of the respective test pieces shown in FIG. 7 as aperture values.

The embodiments of this invention in which an exclusive property or privilege is claimed are defined as follows:

What is claimed is:

1. A container for liquid cosmetics comprising a container body and a cap section, wherein said container body comprises:

a bottle section in which liquid cosmetics are contained;

an aperture controlling ring which is rotatably engaged around an axis of a tip of said bottle section and provided with a means for regulating a rotation start position and a rotation limit position of said aperture controlling ring;

a distinguishable structure for indicating an angle of rotation of said aperture controlling ring and said bottle section from a rotation start position to a rotation limit position in a manner which allows a user to distinguish the quantity of rotations;

a neck section which is unrotatably and slidably provided in said bottle section, moves in an axial direction resulting from relative rotations of said aperture controlling ring and said bottle section, and is restricted in its movement in an axial direction by said regulating means; and an elastic body which is fixed in said container body, and adapted to vary an aperture of a center opening of said elastic body from contact of an aperture controlling section provided at a tip of said neck section with said elastic body to control the quantity of application of said liquid cosmetics adhered to an applicator, said cap section being provided with a stick-shaped member having said applicator at its tip.

2. A container for liquid cosmetics according to claim 1, wherein a distance of movement in an axial direction of said neck section, which is spirally engaged with said aperture controlling ring, at the time of expanding a size of said center opening of said elastic body in said container body from a predetermined minimum size to a predetermined maximum size is determined based on quantity of rotations of said aperture controlling ring from a rotation start position to a rotation limit position.

3. A container for liquid cosmetics according to claim 1, wherein an angle of rotation of said aperture controlling ring and said bottle section controlled by said regulating means is 360 degrees or less.

4. A container for liquid cosmetics according to claim 1, wherein said distinguishable structure carries out selective indications using figures or patterns provided on said bottle section which are visible through a through hole made on said aperture controlling ring.

5. A container for liquid cosmetics according to claim 1, wherein said stick-shaped member having said applicator is provided with a thin diameter section, a taper section, and a section inserted-into neck section; a contact section of said center opening of said elastic body provided in said container body always being in contact with a position in an area covering from said thin diameter section to said taper section; and said section inserted-into neck section of said stick-shaped member is able to go in and out of said neck section leaving a minimum space between said section inserted-into neck section and an inner circumference of a through hole of said neck section.

6. A container for liquid cosmetics comprising:

a container body in which liquid cosmetics are contained; and a cap section to which a stick-shaped member having an applicator at its tip is fixed, wherein said container body comprises:

a bottle section comprising an elastic body for drawing said applicator;

an aperture controlling ring which is rotatably engaged with said bottle section;

a distinguishable structure for indicating an angle of rotation of said aperture controlling ring and said bottle section from a rotation start position to a rotation limit position in a manner which allows a user to distinguish the quantity of rotations; and a neck section which moves in an axial direction resulting from rotations of said aperture controlling ring and which forms at its tip an aperture controlling section to control an aperture of a center opening of said elastic body, and further a sealing member for interrupting ventilation is provided between an outer circumference of said neck section and an inner circumference of said bottle section.

* * * * *